US009565501B2

(12) United States Patent
Barthel et al.

(10) Patent No.: US 9,565,501 B2
(45) Date of Patent: Feb. 7, 2017

(54) HEARING DEVICE AND METHOD OF IDENTIFYING HEARING SITUATIONS HAVING DIFFERENT SIGNAL SOURCES

(71) Applicant: SIVANTOS PTE. LTD., Singapore (SG)

(72) Inventors: Roland Barthel, Forchheim (DE); Matthias Mueller-Wehlau, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 211 days.

(21) Appl. No.: 14/322,008

(22) Filed: Jul. 2, 2014

(65) Prior Publication Data

US 2015/0010182 A1 Jan. 8, 2015

(30) Foreign Application Priority Data

Jul. 2, 2013 (DE) ..... 10 2013 212 853

(51) Int. Cl.
*H04R 25/00* (2006.01)

(52) U.S. Cl.
CPC ..... *H04R 25/50* (2013.01); *H04R 25/43* (2013.01); *H04R 25/453* (2013.01); *H04R 25/552* (2013.01); *H04R 25/554* (2013.01)

(58) Field of Classification Search
CPC ..... H04R 25/43; H04R 25/50; H04R 25/554
USPC ..... 381/312, 320
See application file for complete search history.

(56) References Cited

U.S. PATENT DOCUMENTS

| | | | | |
|---|---|---|---|---|
| 8,355,516 | B2 | 1/2013 | Steinbuss | |
| 2009/0296965 | A1 | 12/2009 | Kojima | |
| 2010/0104120 | A1* | 4/2010 | Steinbuss | 381/312 |
| 2011/0142268 | A1 | 6/2011 | Iwakuni et al. | |
| 2012/0114155 | A1 | 5/2012 | Nishizaki et al. | |
| 2013/0094683 | A1 | 4/2013 | Hansen | |

FOREIGN PATENT DOCUMENTS

EP 2182741 A1 5/2010

* cited by examiner

*Primary Examiner* — Ahmad F Matar
*Assistant Examiner* — Katherine Faley
(74) *Attorney, Agent, or Firm* — Laurence A. Greenberg; Werner H. Stemer; Ralph E. Locher

(57) ABSTRACT

A hearing aid has an acoustoelectric transducer, a pickup device for picking up an electrical or electromagnetic signal and converting it into an electrical signal. The hearing aid further has a signal processing device, an electromechanical transducer for outputting an acoustic signal, and a signal estimation device. The signal estimation device determines a correlation between signals of the acoustoelectric transducer and of the pickup device. The signal processing device adjusts a mixing ratio of the signals in the output signal depending on the correlation.

6 Claims, 3 Drawing Sheets

HEARING DEVICE AND METHOD OF IDENTIFYING HEARING SITUATIONS HAVING DIFFERENT SIGNAL SOURCES

CROSS-REFERENCE TO RELATED APPLICATION

This application claims the priority, under 35 U.S.C. §119, of German patent application DE 10 2013 212 853.3, filed Jul. 2, 2013; the prior application is herewith incorporated by reference in its entirety.

BACKGROUND OF THE INVENTION

Field of the Invention

The invention relates to a hearing aid, wherein the hearing aid has an acoustoelectric transducer for converting an acoustic signal into a first electrical signal and a pickup device for picking up an electrical or electromagnetic signal and converting it into a second electrical signal. The hearing aid additionally has a classification device, wherein the signal estimation device is connected in signal communication with the acoustoelectric transducer and the pickup device. The hearing aid also has a signal processing device, wherein the signal processing device is connected in signal communication with the acoustoelectric transducer, the pickup device and the signal estimation device and is configured to receive the first and the second electrical signal and process them into a third electrical signal. Lastly the hearing aid has an electromechanical transducer which is connected in signal communication with the signal processing device and is configured to convert the third electrical signal into an acoustic signal and output it.

Hearing aids are portable hearing devices for use by the hard of hearing. In order to meet the numerous individual requirements and preferences, different hearing aids types are available, such as behind-the-ear (BTE) hearing aids, hearing aids with external receiver (RIC: receiver in the canal) and in-the-ear (ITE) hearing aids, e.g. concha or completely-in-canal (ITE, CIC) devices. The hearing instruments listed by way of example are worn on the outer ear or in the auditory canal. However, bone conduction hearing aids, implantable or vibrotactile hearing aids are also commercially available. In these cases, the damaged hearing is stimulated either mechanically or electrically.

The basic components of a hearing aid are primarily an input transducer, an amplifier and an output transducer. The input transducer is generally an acoustoelectric transducer, e.g. a microphone, and/or an electromagnetic pickup such as an induction coil. The output transducer is mainly implemented as an electro-acoustic transducer, e.g. a miniature loudspeaker, or as an electromechanical transducer such as a bone conduction receiver. The amplifier is usually incorporated in a signal processing device.

When an acoustic wave and electromagnetic signal arrive simultaneously, this can result in auditory interference if both signals originate from a common source, e.g. a TV with loudspeaker and simultaneous infrared or Bluetooth transmission, and the direct acoustic signal and the electromagnetic signal decoded by the hearing aid reach the ear drum with a different time delay. In this case it makes no difference whether the acoustic signal reaches the ear drum directly, e.g. through a vent hole in an earmold, through an open-fit system or after processing via microphone, signal processing device and electromechanical transducer. Due to interference, the time delay then results, for example, in signal loss or amplification depending on the frequency.

Commonly assigned U.S. Pat. No. 8,355,516 B2 and its counterpart European patent publication EP 2182741 A1 describe a hearing instrument having a microphone and a receiving device for picking up an electrical or electromagnetic signal. The hearing instrument has a signal estimation device which detects the microphone and receiving device signals and, by evaluating the signals on the basis of the levels and/or a correlation, identifies a hearing situation and activates an appropriate hearing program such as noise reduction or feedback suppression. It is thus proposed, for example, to evaluate the hearing situation solely on the basis of the microphone signal in the event of a high correlation of the signals.

However, the prior art hearing programs are not configured to detect and reduce problems which do not arise until after signal processing in the hearing instrument in the ear itself depending on the hearing situation.

United States patent application publication US 2012/0114155 A1 describes a hearing aid having a microphone and an external signal input. The hearing aid also has a mixer for mixing the two input signals and a comparison unit for determining whether the microphone signal is that of the external signal input. A mixing decision unit connected to the comparison unit determines a mixing ratio of a microphone signal and a signal from the external signal input.

SUMMARY OF THE INVENTION

It is accordingly an object of the invention to provide a device and a method for identifying hearing situations with different signal sources which overcome the disadvantages of the heretofore-known devices of this general type and which provide a hearing instrument which offers the wearer a better hearing experience in a hearing situation with simultaneous acoustic and electrical or rather electromagnetic transmission of an input signal.

With the above and other objects in view there is provided, in accordance with the invention, a hearing aid, comprising:

an acoustoelectric transducer for converting an acoustic signal into a first electrical signal;

a pickup device for picking up an electrical or electromagnetic signal and converting the electrical or electromagnetic signal into a second electrical signal;

a signal estimation device connected in signal communication with said acoustoelectric transducer and said pickup device;

a signal processing device connected in signal communication with said acoustoelectric transducer, with said pickup device and with said signal estimation device, said signal processing device being configured to receive the first electrical signal and the second electrical signal and to process the first and second electrical signals into a third electrical signal;

an electromechanical transducer connected in signal communication with said signal processing device and configured to convert the third electrical signal into an acoustic signal and to output the acoustic signal;

wherein said signal estimation device is configured to determine a correlation between the first electrical signal and the second electrical signal and to communicate the correlation to said signal processing device, and said signal processing device is configured to adjust a proportion of the first electrical signal and of the second electrical signal in the third electrical signal depending on the correlation; and wherein said signal estimation device is configured to determine the correlation in a predetermined first frequency range of a plurality of separate or partially overlapping frequency ranges.

In other words, the hearing aid according to the invention has an acoustoelectric transducer for converting an acoustic signal into a first electrical signal and a pickup device for picking up an electrical or electromagnetic signal and converting it into a second electrical signal. The hearing aid also has a signal estimation device, wherein the signal estimation device is connected in signal communication with the acoustoelectric transducer and the pickup device. In addition, the hearing aid has a signal processing device which is connected in signal communication with the acoustoelectric transducer, the pickup device and the signal estimation device and is designed to receive the first and the second electrical signal and process them into a third electrical signal. The hearing aid lastly has an electromechanical transducer which is connected in signal communication with the signal processing device and is designed to convert the third electrical signal into an acoustic signal and output it.

The signal estimation device is configured to determine a correlation between the first and the second electrical signal and communicate the correlation to the signal processing device, wherein the signal processing device is designed to adjust a proportion of the first and of the second electrical signals in the third electrical signal as a function of the correlation.

Advantageously, the hearing aid according to the invention can make the composition of the third signal and therefore of the signal outputted at the receiver dependent on whether the electrical/electromagnetic signal transmission and the acoustic signals are transmitting matching signals and can therefore interfere with one another.

In a preferred embodiment of the hearing aid, the signal processing device is designed to reduce the proportion of the second electrical signal in the third electrical signal as the correlation increases.

By reducing the proportion of the second electrical signal originating from the electrical/electromagnetic pickup device relative to the acoustically received microphone signal in the output signal, it is advantageous particularly in the case of a hearing aid having a vent hole or open-fit system that the phase-shifted and/or delayed electrically transmitted signal can no longer, or only to a limited extent, interfere with the acoustic signal received directly at the ear drum or by the microphone and is less distorted thereby.

In accordance with a preferred feature of the invention, the hearing aid is configured to determine the correlation in a first predetermined frequency range.

If two signals from a natural source (e.g. speech, music) are correlated with one another, this is usually across the entire frequency range of the signals. It is therefore sufficient to check only a predetermined frequency range in order to establish a correlation. It is particularly advantageous here that the correlation checking allows more selective correlation estimation in a narrower frequency range and additionally requires less computing capacity and memory.

In a possible embodiment of the hearing aid, the signal processing device is designed to adjust the proportion of the first and of the second electrical signal in the third electrical signal in a predetermined second frequency range. It is conceivable that the first and the second frequency range are different in this case.

Because of the correlation of natural signals across the entire frequency range, it is also conceivable for the proportions of signals in a second frequency range to be inventively adjusted as a function of the correlation in a first frequency range, the frequency ranges being completely different or only partially overlapping. It is thus advantageously possible to prevent interference especially in frequency ranges in which it is particularly severe or experienced as being particularly annoying.

In a conceivable embodiment of the hearing aid according to the invention, the second frequency range is predetermined completely or partially below the first frequency range.

In the case of open-fit hearing aids or a vent hole, in particular low-frequency acoustic waves with low attenuation pass directly to the ear drum where they cause interference with the acoustic waves produced by the hearing aid from the electrical/electromagnetic signal. It is therefore particularly advantageous for the experience of sound to reduce this particular frequency range of the signals transmitted electrically/electromagnetically from the receiver.

The advantages described likewise apply to the inventive method for operating the hearing aid according to the invention.

With the above and other objects in view there is also provided in accordance with the invention, a method of operating the above-described hearing aid. The method comprises the following steps:

converting an acoustic signal into a first electrical signal by the acoustoelectric transducer;

receiving and converting an electrical or electromagnetic signal into a second electrical signal by the pickup device;

determining a correlation between the first electrical signal and the second electrical signal by the signal estimation device and communicating the correlation to the signal processing device, the signal estimation device determining the correlation in a first predetermined frequency range of a plurality of separate or partially overlapping frequency ranges; and combining the first electrical signal and the second electrical signal to form a third electrical signal and thereby adjusting a proportion of the first electrical signal and of the second electrical signal in the third electrical signal by the signal processing device in dependence on the correlation.

Other features which are considered as characteristic for the invention are set forth in the appended claims.

Although the invention is illustrated and described herein as embodied in Identification of hearing situations having different signal sources, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
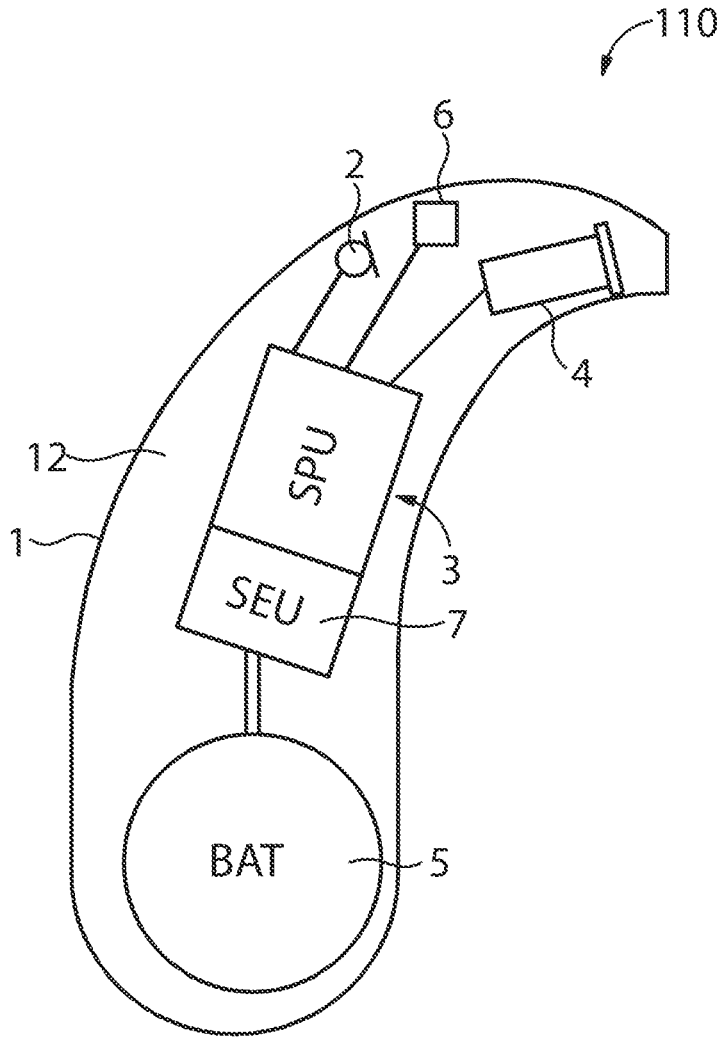
FIG. 1 is a schematic diagram of a hearing aid according to the invention, formed as a BTE hearing device.

Referring now to the figures of the drawing in detail and first, particularly, to FIG. 1 thereof, there is shown the basic design of a hearing aid 110 according to the invention. Installed in a hearing aid case or housing 1 for wearing behind the ear are one or more microphones 2 for picking up sound or rather acoustic signals from the environment. The microphones 2 are acoustoelectric transducers 2 for converting the sound into first electrical signals. The hearing aid 110 also has a pickup device 6 for picking up an electrical or electromagnetic signal and converting it into a second electrical signal. A signal processing device (SPU) 3 which is likewise incorporated in the hearing aid case 1 processes the first electrical signals, for which purpose it is connected in signal communication with the microphone 2 and the pickup device 6. The output signal of the signal processing device 3 is transmitted to a loudspeaker or receiver 4, which outputs an acoustic signal. In some cases the sound is transmitted to the wearer's ear drum via a sound tube which is fixed in the auditory canal using an earmold. Aside from the electroacoustic transducers, other electromechanical transducers are conceivable, such as bone conduction receivers, for example. The hearing aid, and in particular the signal processing device 3, are powered by a battery (BAT) 5 likewise incorporated in the hearing aid case 1.

The hearing aid 110 according to the invention also has a signal estimation device 7 or signal estimation unit (SEU). The device 7, as illustrated in FIG. 1, is part of the signal processing device 3, or alternatively can also be implemented as a separate signal estimation device 7 in the hearing aid 110. The other signal processing functions of the signal processing 3 are indicated as a functional block 12. The signal estimation device 7 is connected in signal communication with the microphone 2 and the pickup device 6. The signal estimation device 7 is configured to determine a correlation between the first electrical signal 10 of the microphone 2 and the second electrical signal 11 of the pickup device 6. The result of the classification is communicated by the signal estimation device 7 to the signal processing device 3 via a signal connection. The correlation between the first electrical signal 10 and the second electrical signal 11 can be determined by way of a correlation algorithm of the kind described by Karl Pearson in 1895, and known as the "Pearson Product-Moment Correlation Coefficient." The correlation coefficient is also known as the PPMCC or PCC or Pearsons's r.

Figure 2:
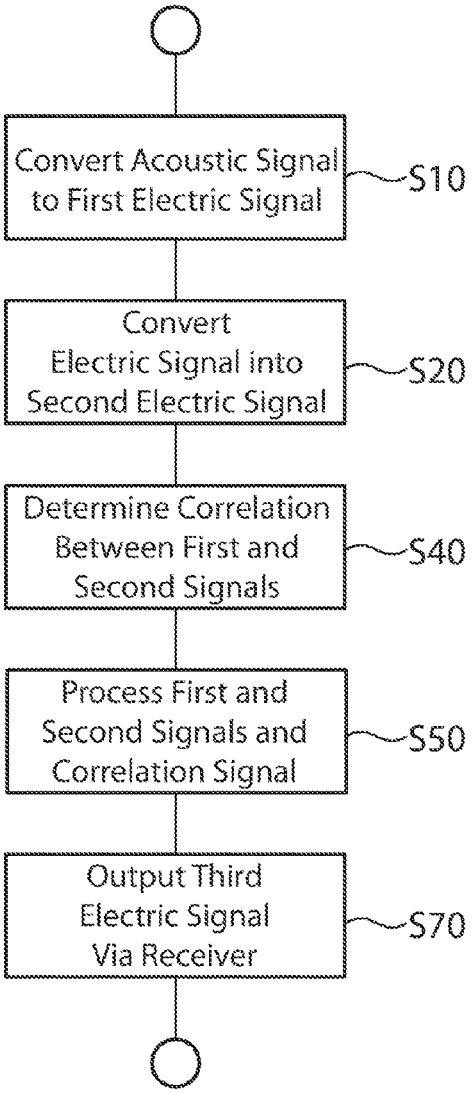
FIG. 2 shows a schematic flow chart of a method according to the invention.

FIG. 2 shows a schematic flow chart of a method according to the invention.

In step S10, an acoustic signal is picked up by a microphone 2 and converted into a first electrical signal 1.

In step S20, an electrical or electromagnetic signal containing acoustic information is picked up via the pickup device 6 and converted into a second electrical signal 11.

In step S40, a correlation between the first electrical signal 10 and the second electrical signal 11 is determined by the signal estimation device 7 using a correlation measuring method as described, for example, in Wikipedia under "Pearson product-moment correlation coefficient".

In step S50, the signal processing device 3 receives the first electrical signal 10, the second electrical signal 11 and a signal representing the correlation determined in step S40. The signal processing device carries out the processing steps necessary in a hearing aid 110 for compensating the hearing deficiency, e.g. adapting the frequency response, gain or even noise suppression. According to the invention, in step S50 a proportion of the first electrical signal 10 and of the second electrical signal 11 in a third electrical signal is adjusted depending on the correlation. Said proportion of the second electrical signal 11 in the third electrical signal is preferably reduced as the correlation increases. However, other mixing ratios are also conceivable.

In step S70, the third electrical signal is output via the receiver 4, which converts it into acoustic waves.

Figure 3:
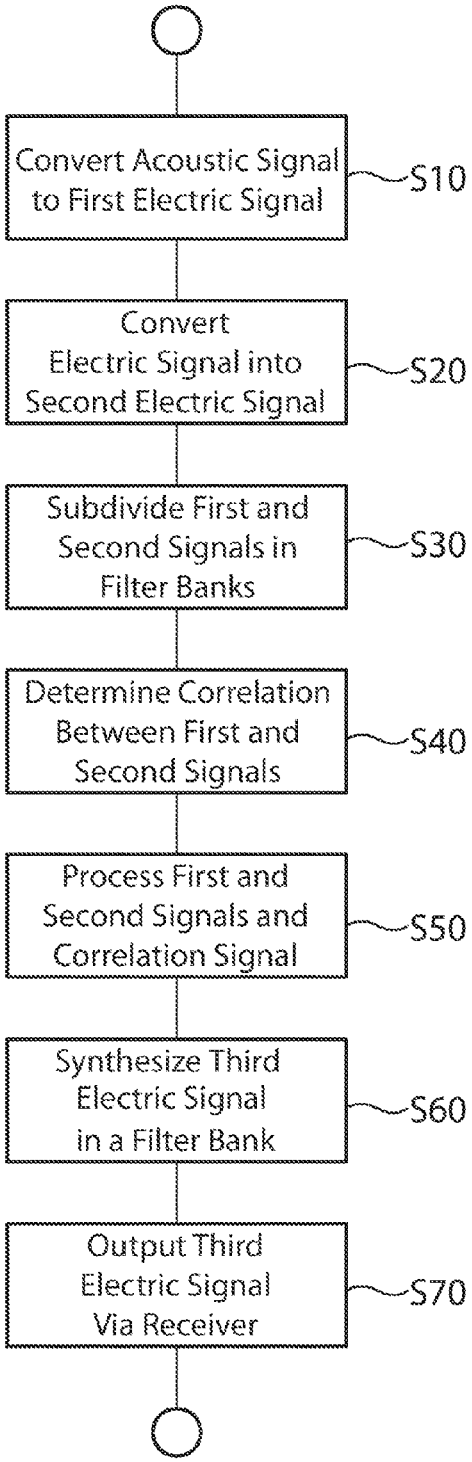
FIG. 3 shows a schematic flow chart of a method according to the invention.

FIG. 3 shows a schematic flow chart of another inventive method which has additional steps S30 and S60, but otherwise corresponds to the method in FIG. 2.

In step S30, the first electrical signal 10 and the second electrical signal 11 are subdivided in filter banks 8 into signals for individual, separate or partially overlapping frequency ranges.

In step S40, it is therefore possible to determine the correlation in a first or a plurality of frequency ranges.

In step S50 it is likewise possible to adjust the proportion of the first electrical signal 10 and of the second electrical signal 11 in the third electrical signal depending on the determined correlation in a second or a plurality of frequency ranges. For the adjustment, the second frequency range or the plurality of frequency ranges is/are preferably below the first frequency range.

In step S60, the frequency ranges of the third electrical signal processed in step S50 are again synthesized in a filter bank into a single third electrical signal which encompasses a plurality of frequency ranges.

Figure 4:
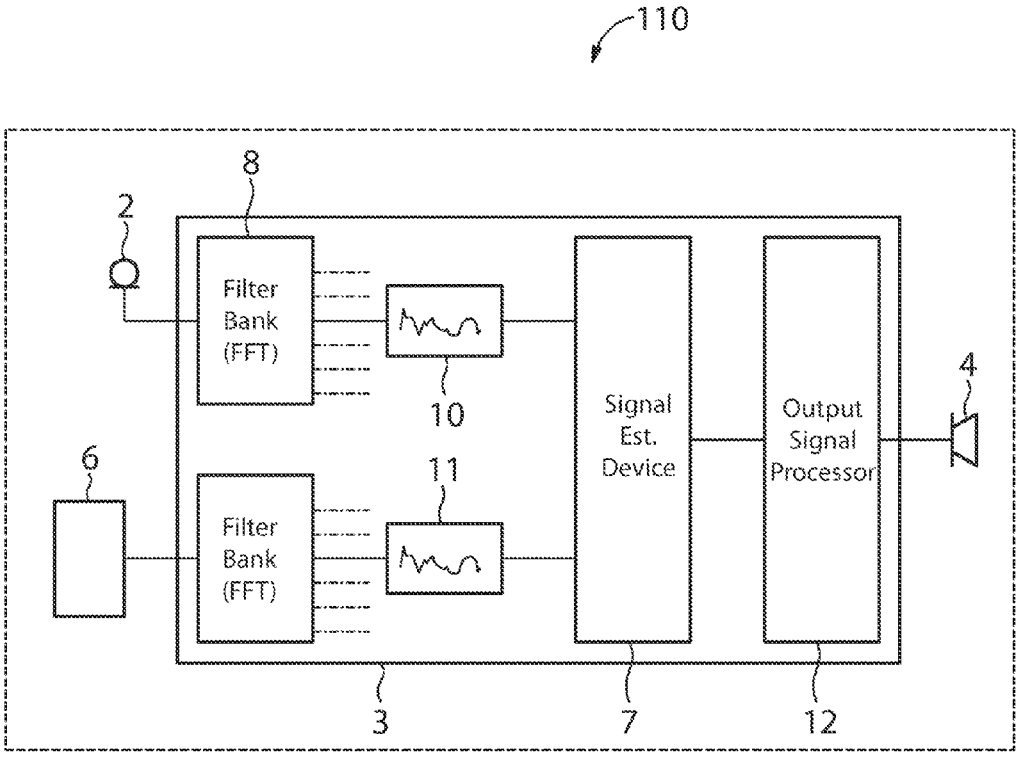
FIG. 4 is a diagrammatic a representation of a hearing aid according to the invention in functional blocks.

FIG. 4 shows a representation of a hearing aid according to the invention in functional blocks for carrying out the method illustrated in FIG. 3. The hearing aid 110 has a microphone 2, i.e. an acoustoelectric transducer 2, for converting an acoustic signal into a first electrical signal and a pickup device 6 for picking up an electrical or electromagnetic signal and converting it into a second electrical signal. The first electrical signal 10 and the second electrical signal 11 are fed to a signal processing device 3 which is part of the hearing aid 110.

In the signal processing device 3, the first electrical signal 10 and the second electrical signal 11 are subdivided by filter banks 8 into a plurality of first signals 10 and second signals 11 in a plurality of frequency ranges. The filter banks 8 can employ a fast Fourier transform in a signal processor of the signal processing device 3. It is possible here that only a lower and an upper frequency band are produced, the frequencies of the lower band being lower than the frequencies of the upper band. It is also conceivable that the two frequency bands do not overlap at all or only at the edge. However, it is also possible for a large number of signals to be produced in divergent or only slightly overlapping frequency bands.

The first electrical signals 10 and the second electrical signals 11 are fed to a signal estimation device 7. The signal estimation device 7 determines preferably in a first frequency band a correlation between the first signals 10 and second signals 11 and outputs to the signal processing device 3 a signal that provides a measure of the correlation determined. However, it is likewise conceivable for the correlation to be determined for a plurality of frequency bands or a completely transmitted frequency range.

The correlation can be determined, for example, using a correlation measuring method as first described by Karl Pearson, and known as the "Pearson product-moment correlation coefficient."

The signal estimation device 7 is connected in signal communication with a functional block 12 which represents the other signal processing functions. The functional block 12 receives the first electrical signals 10 and the second electrical signals 11 as well as a signal from the signal estimation device 7 which provides a measure of the correlation between the first electrical signal 10 and the second electrical signal 11.

The functional block 12 produces from these signals a third electrical signal, wherein the functional block 12 adjusts a proportion of the first and second electrical signal 11, 12 in the third electrical signal according to the correlation, said functional block 12 reducing a proportion of the second electrical signal 11 in the third electrical signal as the correlation increases.

The functional block 12 adjusts the proportion of the first and of the second electrical signal 10, 11 in the third electrical signal in a predetermined second frequency range, wherein the second frequency range is predetermined completely or partially below the first frequency range. The second frequency range is preferably at the lower end of the hearing spectrum, e.g. below 1000 Hz, 800 Hz, 500 Hz or even 200 Hz. This frequency range is characterized by the fact that its acoustic waves having the specified frequencies can preferably pass directly to the ear drum in the case of open-fit or through a vent hole and may therefore interfere with the acoustic waves emitted by the receiver. Particularly the upper limit frequency of the second frequency range is therefore dependent on the characteristics of the hearing aid, e.g. the geometry of the vent hole.

The functional block 12 also performs other signal processing functions of the kind normally required in a hearing aid 110 to improve the wearer's hearing experience. This is, for example, a frequency-dependent amplification of the third signal in order to compensate for a decrease in the wearer's hearing sensitivity and generate a sufficiently high level for outputting the signal as sound via the receiver 4. In the embodiment shown, with signals subdivided into frequency bands, the individual frequency bands are also combined into a single output signal by means of a synthesis function. However, other more complex functions are also conceivable, such as noise suppression, adaptive filters, feedback or echo cancellation and others.

The hearing aid 110 according to the invention can also be part of a binaural hearing aid system, wherein the signal estimation device 7 could then, for example, use the first electrical signals of both hearing aids 110, with the result of the classification being used in the same way on both hearing aids as shown. Combination with other binaural functions such as adaptive directional microphones and functions for improving spatial hearing is also conceivable.

Although the invention has been illustrated and described in detail by the preferred exemplary embodiment, the invention is not limited by the examples disclosed and other variations can be inferred therefrom by the person skilled in the art without departing from the scope of protection sought for the invention.

The invention claimed is:

1. A hearing aid, comprising:

an acoustoelectric transducer for converting an acoustic signal into a first electrical signal;

a pickup device for picking up an electrical or electromagnetic signal and converting the electrical or electromagnetic signal into a second electrical signal;

a signal estimation device connected in signal communication with said acoustoelectric transducer and said pickup device;

a signal processing device connected in signal communication with said acoustoelectric transducer, with said pickup device and with said signal estimation device, said signal processing device being configured to receive the first electrical signal and the second electrical signal and to process the first and second electrical signals into a third electrical signal;

an electromechanical transducer connected in signal communication with said signal processing device and configured to convert the third electrical signal into an acoustic output signal and to output the acoustic output signal;

wherein said signal estimation device is configured to determine a correlation between the first electrical signal and the second electrical signal and to communicate the correlation to said signal processing device, and said signal processing device is configured to adjust a proportion of the first electrical signal and of the second electrical signal in the third electrical signal depending on the correlation; and wherein said signal estimation device is configured to determine the correlation in a predetermined first frequency range of a plurality of separate or partially overlapping frequency ranges, and said signal processing device is configured to adjust the proportion of the first electrical signal and of the second electrical signal in the third electrical signal in a predetermined second frequency range of the plurality of separate or partially overlapping frequency ranges.

2. The hearing aid according to claim 1, wherein said signal processing device is configured to reduce the proportion of the second electrical signal in the third electrical signal as the correlation increases.

3. The hearing aid according to claim 1, wherein the first frequency range and the second frequency range are mutually different frequency ranges.

4. The hearing aid according to claim 1, wherein the second frequency range lies completely below the first frequency range.

5. The hearing aid according to claim 1, wherein the second frequency range lies partially below the first frequency range.

6. A method of operating a hearing aid, the hearing aid having:

an acoustoelectric transducer;

a pickup device;

a signal estimation device connected in signal communication with the acoustoelectric transducer and the pickup device;

a signal processing device connected in signal communication with the acoustoelectric transducer, the pickup device and the signal estimation device; and an electromechanical transducer connected in signal communication with the signal processing device;

the method comprising the following steps:

converting an acoustic signal into a first electrical signal by the acoustoelectric transducer;

receiving and converting an electrical or electromagnetic signal into a second electrical signal by the pickup device;

determining a correlation between the first electrical signal and the second electrical signal by the signal estimation device and communicating the correlation to the signal processing device, the signal estimation device determining the correlation in a first predetermined frequency range of a plurality of separate or partially overlapping frequency ranges;

combining the first electrical signal and the second electrical signal to form a third electrical signal and thereby adjusting a proportion of the first electrical signal and of the second electrical signal in the third electrical signal by the signal processing device in dependence on the correlation, and adjusting the proportion of the first electrical signal and of the second electrical signal in the third electrical signal in a predetermined second frequency range of the plurality of separate or partially overlapping frequency ranges; and converting the third electrical signal to an acoustic output signal and outputting the acoustic output signal with the electromechanical transducer.

* * * * *